US007730607B2

(12) United States Patent
Chi et al.

(10) Patent No.: US 7,730,607 B2
(45) Date of Patent: Jun. 8, 2010

(54) APPARATUS FOR ASSEMBLING CABLE TO CONNECTOR

(75) Inventors: Ming-Chia Chi, Taipei Hsien (TW); Chih-Cheng Wu, Taipei Hsien (TW); Yu-Tso Liu, Taipei Hsien (TW); Chin-Chiang Li, Taipei Hsien (TW); Yu-Hua Hsieh, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 441 days.

(21) Appl. No.: 11/936,028

(22) Filed: Nov. 6, 2007

(65) Prior Publication Data

US 2009/0113699 A1 May 7, 2009

(51) Int. Cl.
*H01R 43/00* (2006.01)
*H01B 17/32* (2006.01)

(52) U.S. Cl. ..... 29/749; 29/747; 29/748; 29/754; 29/755; 29/33 M; 174/210

(58) Field of Classification Search ..... 29/748, 29/749, 747, 754, 755, 33 M, 760, 832; 439/249, 439/252, 248, 495, 498; 174/180, 185, 194, 174/201, 210; 269/287, 903, 40, 45
See application file for complete search history.

(56) References Cited

U.S. PATENT DOCUMENTS

| | | | | |
|---|---|---|---|---|
| 3,972,101 | A * | 8/1976 | Casey et al. | 29/749 |
| 4,895,425 | A * | 1/1990 | Iwano et al. | 385/60 |
| 5,031,312 | A * | 7/1991 | Culbertson et al. | 29/828 |
| 5,549,485 | A * | 8/1996 | Chishima et al. | 439/495 |
| 6,482,028 | B2 * | 11/2002 | Kumamoto et al. | 439/498 |

* cited by examiner

*Primary Examiner*—Derris H Banks
*Assistant Examiner*—Tai Nguyen
(74) *Attorney, Agent, or Firm*—WPAT, P.C.; Anthony King

(57) ABSTRACT

An apparatus for assembling cable to connector includes a jig holder and a cable jig. The jig holder has a basic board defining a mounting space capable of locating a connector in the front thereof. The cable jig located in the rear of the mounting space of the jig holder has an upper jig member and a lower jig member disposed beneath the upper jig member. One of the jig members protrudes to form first spaced-apart barriers. A first receiving passage is defined between each pair of adjacent first spaced-apart barriers. The other jig member defines second receiving passages for receiving the first spaced-apart barriers respectively. A second spaced-apart barrier is defined between every two adjacent second receiving passages to space the two adjacent second receiving passages apart. The second spaced-apart barriers are inserted in the first receiving passages respectively.

10 Claims, 5 Drawing Sheets

APPARATUS FOR ASSEMBLING CABLE TO CONNECTOR

BACKGROUND OF THE INVENTION

1. Field of the Invention

The present invention relates to an apparatus for assembling a cable to a connector, and more particularly to a semi-automatic apparatus for assembling a High-Definition Multimedia Interface (HDMI) cable to a HDMI connector.

2. The Related Art

In recent years, as digital televisions and high definition televisions are used extensively, a HDMI is correspondingly applied broadly. The HDMI is an industry-supported, all-digital audio/video interface. By delivering crystal-clear, all-digital audio/video via a single cable, the HDMI dramatically simplifies the cables and helps to provide consumers with the highest-quality home theater experience. The HDMI provides an interface between any audio/video sources, such as a set-top box, a DVD player, an A/V receiver or an audio and/or video monitor, over a single cable.

Conventionally, assembling a HDMI cable to a HDMI connector is through a method of soldering tin by hand. In the assembly process, a worker firstly strips the insulating shell of the HDMI cable to expose four pairs of wires integrated in the HDMI cable, and then strips the insulating shells of the wires. The worker puts the wires in connecting ends of the HDMI connector respectively, and thereafter welds the wires to the connecting ends one by one through soldering tin by hand. However, the worker is easy to feel tired after a long time work, which reduces the assembly efficiency. Even more, the wires are prone to be disarrayed and it is easy to wrongly mate the wires with the connecting ends of the HDMI connector, which brings a bad influence on the electrical property of the HDMI connector.

SUMMARY OF THE INVENTION

Accordingly, an object of the present invention is to provide an apparatus for assembling a cable to a connector. The apparatus includes a jig holder and a cable jig. The jig holder has a basic board defining a mounting space capable of locating the connector in the front thereof. The cable jig located in the rear of the mounting space of the jig holder has an upper jig member and a lower jig member disposed beneath the upper jig member. One of the jig members protrudes to form first spaced-apart barriers. A first receiving passage is defined between each pair of adjacent first spaced-apart barriers. The other jig member defines second receiving passages for receiving the first spaced-apart barriers respectively. A second spaced-apart barrier is defined between every two adjacent second receiving passages to space the two adjacent second receiving passages apart. The second spaced-apart barriers are inserted in the first receiving passages respectively.

As described above, the apparatus locates wires wrapped in the cable in the first receiving passages and the second receiving passages respectively. Then the wires are cut in particular length and insulating shells of ends of the wires are stripped at the same time for being soldered to connecting portions of the connector by a soldering apparatus. Thereby, the wires and the connecting portions of the connector are mated accurately and the connection between the wires and the connecting portions of the connector is stable, which ensures the electrical property of the connector. At the same time, the assembly efficiency is enhanced.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
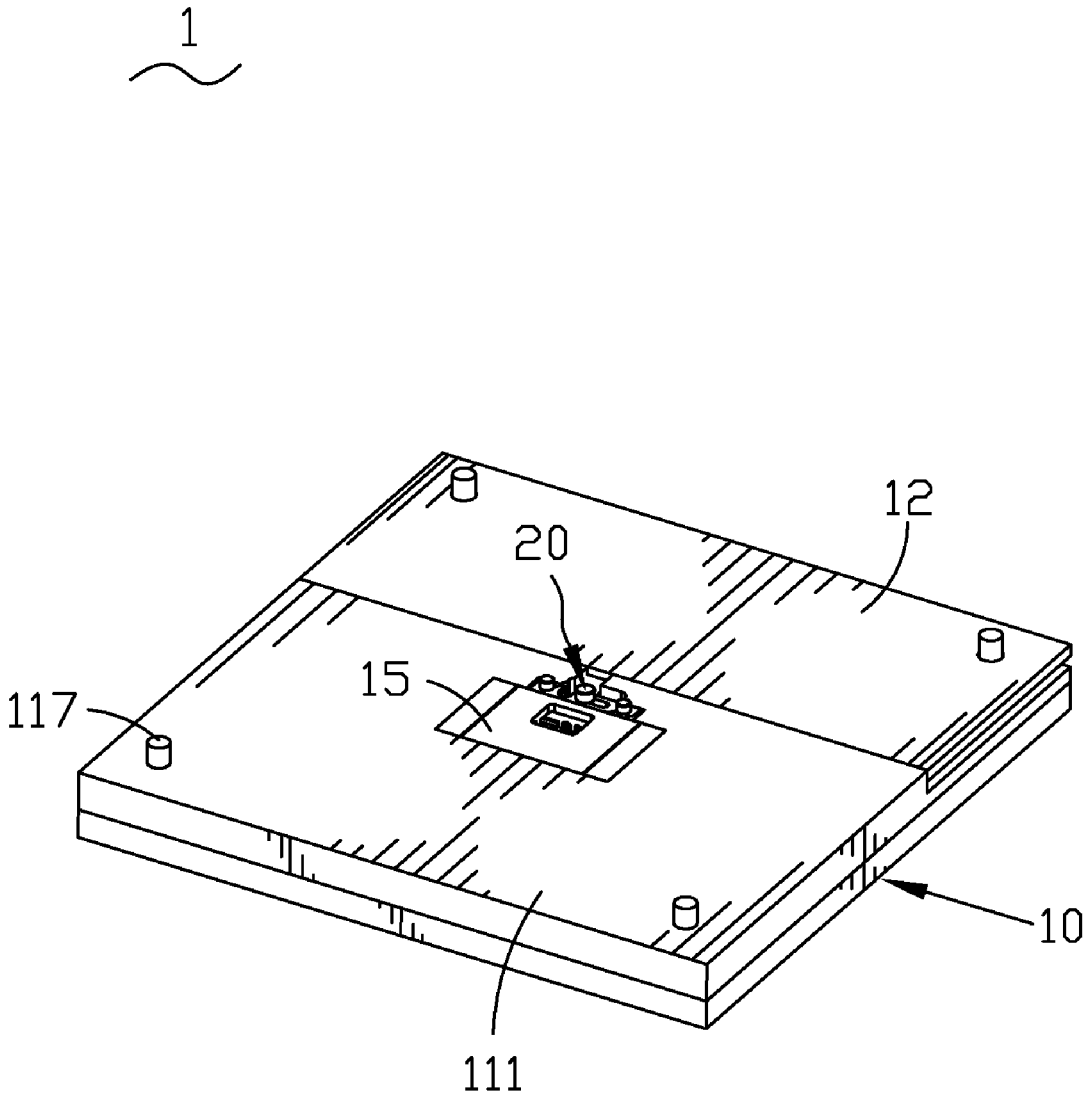
FIG. 1 is a perspective view of an apparatus for assembling cable to connector.

Referring to FIG. 1, an apparatus 1 for assembling cable to connector includes a jig holder 10 and a cable jig 20 mounted in the jig holder 10.

Figure 2:
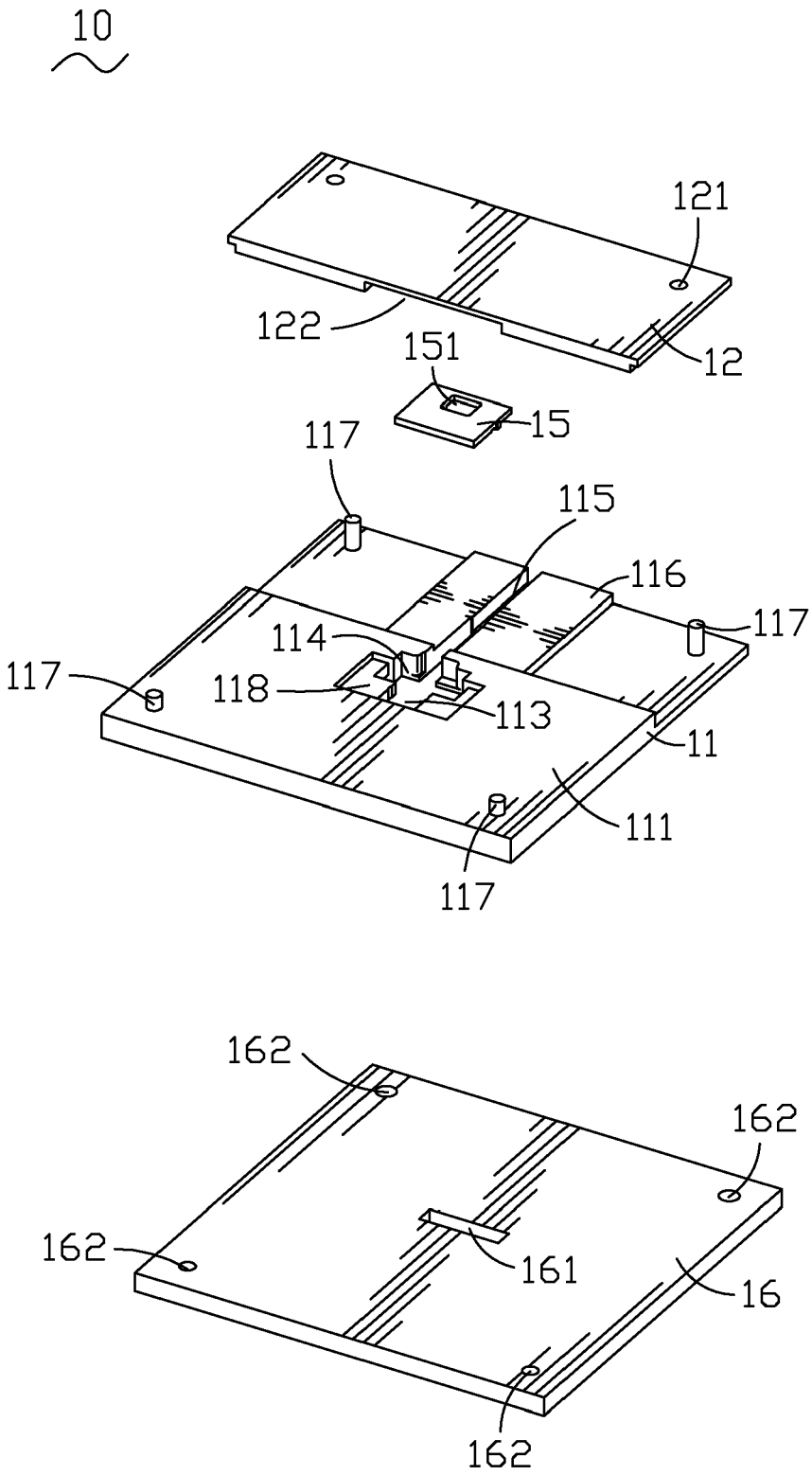
FIG. 2 is an exploded view of a jig holder of the apparatus.

With reference to FIG. 2, the jig holder 10 includes a square basic board 11, a rectangular cover 12 transversely mating with the rear top of the basic board 11 and a square bottom board 16 fittingly located at the bottom of the basic board 11. The basic board 11 extends upward at the front top thereof to form a rectangular assembling platform 111. The rear top of the basic board 11 longitudinally projects upward at center to form a strip of protruding block 116. The protruding block 116 extends forward to connect with a rear surface of the assembling platform 111. The height of the protruding block 116 is lower than the height of the assembling platform 111. Two front corners of the assembling platform 111 and two rear corners of the basic board 11 respectively define a fixing shaft 117 passing therethrough. The assembling platform 111 transversely defines a rectangular mounting opening 113 passing through the assembling platform 111 and the basic board 11 up and down in turn to communicate with the outside at the middle of the rear top thereof. The middle of the rear of the mounting opening 113 transversely defines a rectangular locking gap 114 toward the rear of the assembling platform 111. The locking gap 114 runs through the assembling platform 111 and the basic board 11 up and down in turn to communicate with the outside. A leading groove 115 is longitudinally defined on the rear top of the basic board 11. The leading groove 115 upward passes through the center of the protruding block 116 and forward passes through the rear of the assembling platform 111 to communicate with the locking gap 114. Two L-shaped resisting blocks 118 protrude from bilateral sides of the mounting opening 113 face to face and are disposed in the front of the mounting opening 113. A supporting lid 15 is provided to cover on the top of the mounting opening 113. The supporting lid 15 defines a square hole 151 passing therethrough at the center of the rear top thereof.

The cover 12 in rectangular board-shape defines two first through-holes 121 at rear corners thereof. The two first through-holes 121 pass through the cover 12 and engage with the fixing shafts 117 defined at the rear corners of the basic board 11 for locating the cover 12 on the rear top of the basic board 11. The middle of a bottom surface of the cover 12 longitudinally defines a strip-shaped cavity 122 to receive the protruding block 116, which makes the cover 12 mate with the rear top of the basic board 11 much securer.

The bottom board 16 defines four second through-holes 162 at four corners thereof for receiving the four fixing shafts 117 formed on the basic board 11 respectively to locate the bottom board 16 on the bottom of the basic board 11. The center of the bottom board 16 transversely defines a strip-shaped slot 161 passing therethrough.

Figure 3:
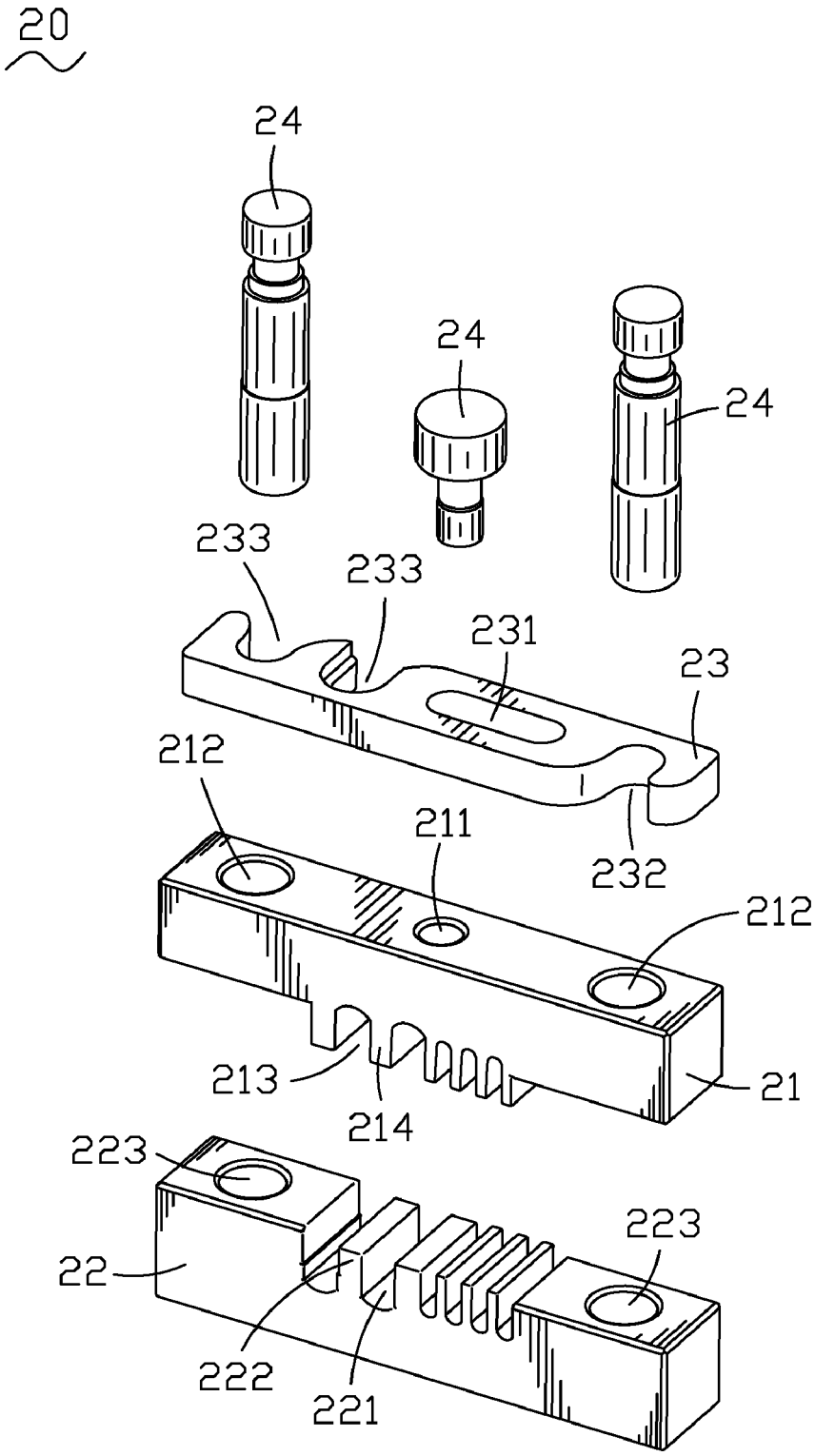
FIG. 3 is an exploded view of a cable jig of the apparatus.

Please refer to FIG. 3. The cable jig 20 mounted in the locking gap 114 of the jig holder 10 includes an upper jig member 21, a lower jig member 22, a positioning member 23 and three locating pins 24. The upper jig member 21 is substantially rectangular and vertically defines two first locating holes 212 passing therethrough at both ends thereof. The center of the top of the upper jig member 21 vertically defines a second locating hole 211. A plurality of first spaced-apart barriers 214 extends downward from a middle of the bottom of the upper jig member 21. A first vaulted receiving passage 213 is defined between each pair of adjacent first spaced-apart barriers 214. Because the thickness of the first spaced-apart barriers 214 is different, the width of the first receiving passages 213 is different.

The lower jig member 22 is symmetrically disposed beneath the upper jig member 21. The lower jig member 22 is substantially rectangular and vertically defines two third locating holes 223 passing therethrough at both ends thereof. The middle of the top of the lower jig member 21 downward defines a plurality of second receiving passages 221. A second spaced-apart barrier 222 is defined between every two adjacent second receiving passages 221 to space the two adjacent second receiving passages 221 apart.

The positioning member 23 is a rectangular sheet of board and disposed on the top of the upper jig member 21. The substantial middle of the positioning member 23 defines a limiting slot 231 passing therethrough. The limiting slot 231 transversely extends toward one end of the positioning member 23. The positioning member 23 defines a first opening positioning recess 232 at one end thereof, and the other end of the positioning member 23 defines two second opening positioning recesses 233 which are abutting. The opening direction of the first positioning recess 232 faces the front, and the opening direction of the second positioning recesses 233 is opposite to the first positioning recess 232, which faces the rear. The locating pin 24 which is smaller than the other two locating pins 24 is inserted in the second locating hole 211 of the upper jig member 21 through the limiting slot 231 for movably locating the positioning member 23 on the top of the upper jig member 21, therefore, the positioning member 23 moving or rotating around the locating pin 24 on the top of the upper jig member 21. The other two locating pins 24 are respectively inserted in the first locating holes 212 and the third locating holes 223 to integrate the upper jig member 21 and the lower jig member 22.

Figure 4:
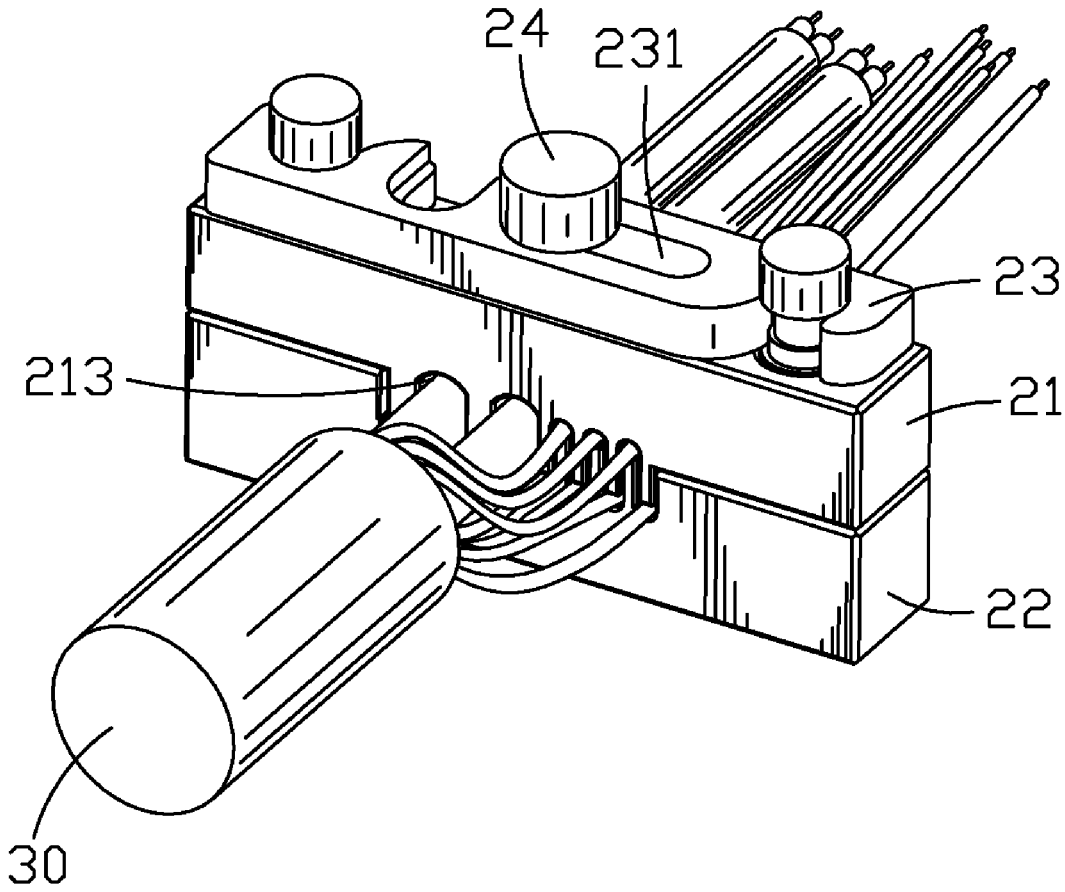
FIG. 4 is a perspective view showing wires wrapped in a cable inserted in the cable jig.

Referring to FIG. 4, when the cable jig 20 is in use, firstly an insulating shell of a HDMI cable 30 is stripped and wires wrapped in the HDMI cable 30 are exposed. Then the wires are put in the first receiving passages 213 of the upper jig member 21 or the second receiving passages 221 of the lower jig member 22 respectively according to the sizes of the wires and the wires extend out of the first receiving passages 213 and the second receiving passages 221. Afterwards, the first spaced-apart barriers 214 of the upper jig member 21 are respectively inserted in the corresponding second receiving passages 221 of the lower jig member 22, and the second spaced-apart barriers 222 are respectively inserted in the corresponding first receiving passages 213 of the upper jig member 21. Moving and rotating the positioning member 23 make the first positioning recess 232 and the second positioning recess 233 receive the two locating pins 24 respectively inserted in the first locating holes 212 and the third locating holes 223. Therefore, the upper jig member 21 and the lower jig member 22 are fixedly assembled together, and the wires of the HDMI cable 30 are located in the first receiving passages 213 and the second receiving passages 221. Lastly, the wires are cut in particular length and then insulating shells of front ends of the wires are stripped at the same time.

Figure 5:
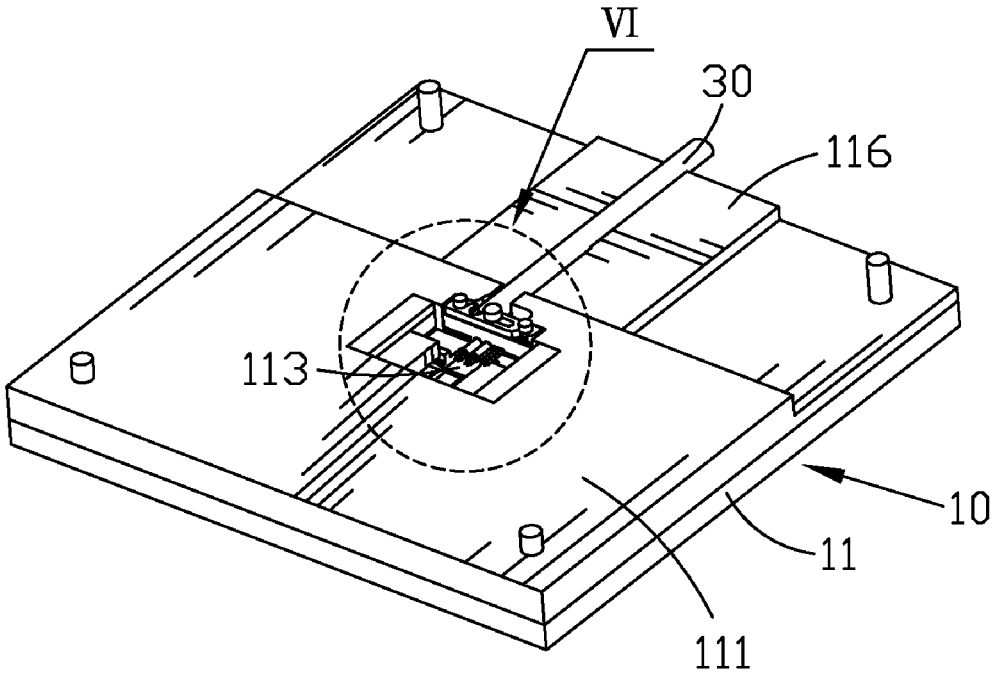
FIG. 5 is a perspective view showing the cable jig that maintains the wires assembled in the jig holder.
Figure 6:
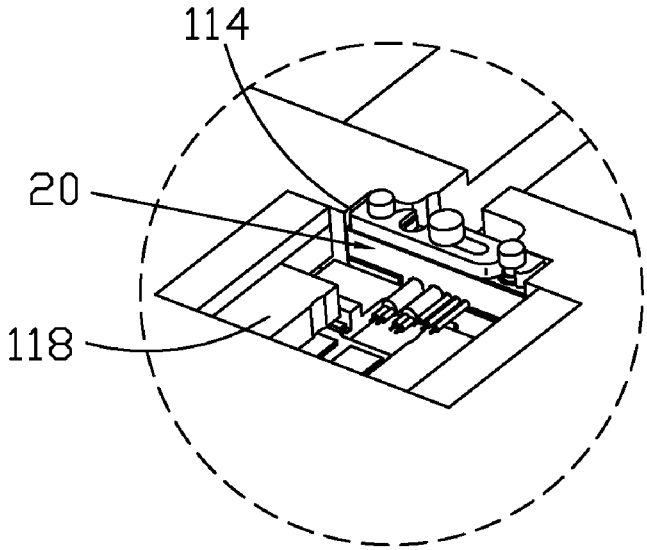
FIG. 6 is a partially enlarged view of the encircled portion labeled VI of FIG. 5.

Please refer to FIG. 5 and FIG. 6 together with FIG. 4. The cable jig 20 is mounted in the locking gap 114 of the jig holder 10, and the two locating pins 24 respectively inserted in the first locating holes 212 and the third locating holes 223 are disposed in the slot 161 of the bottom board 16. The HDMI cable 30 is placed in the leading groove 115 of the basic board 11. The front ends of the wires are received in the mounting opening 113. A HDMI connector (not shown) is located between the two resisting blocks 118, and connecting portions of the HDMI connector faces the front ends of the wires. Then, the front ends of the wires are soldered to the connecting portions of the HDMI connector through a soldering apparatus (not shown). The positioning member 23 is rotated in an opposite direction, and the two locating pins 24 respectively inserted in the first locating holes 212 and the third locating holes 223 are separated from the first positioning recess 232 and the second positioning recess 233. Then, the upper jig member 21 and the lower jig member 22 are separated from each other for taking the HDMI connector and the HDMI cable 30 out.

As described above, the apparatus 1 for assembling cable to connector locates the wires wrapped in the HDMI cable 30 in the first receiving passages 213 and the second receiving passages 221. Then the wires are cut in particular length and then the insulating shells of the front ends of the wires are stripped at the same time for being soldered to the connecting portions of the HDMI connector by the soldering apparatus. Thereby, the wires and the connecting portions of the HDMI connector are mated accurately and the connection between the wires and the connecting portions of the HDMI connector is stable, which ensures the electrical property of the HDMI connector. At the same time, the assembly efficiency is enhanced.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An apparatus for assembling cable to connector, comprising:

a jig holder, having a basic board defining a mounting space capable of locating a connector in the front thereof; and a cable jig, located in the rear of the mounting space of the jig holder, having an upper jig member and a lower jig member disposed beneath the upper jig member, one of the jig members protruding to form first spaced-apart barriers, a first receiving passage defined between each pair of adjacent first spaced-apart barriers, the other jig member defining second receiving passages for receiving the first spaced-apart barriers respectively, a second spaced-apart barrier defined between every two adjacent second receiving passages to space the two adjacent second receiving passages apart, the second spaced-apart barriers inserted in the first receiving passages respectively.

2. The apparatus for assembling cable to connector as claimed in claim 1, wherein the upper jig member vertically defines two first locating holes passing therethrough at both ends thereof, the lower jig member vertically defines two third locating holes passing therethrough at both ends thereof, two locating pins are respectively inserted in the first and third locating holes for assembling the upper jig member and the lower jig member together.

3. The apparatus for assembling cable to connector as claimed in claim 2, wherein the cable jig includes a positioning member disposed on the top of the upper jig member defining a second locating hole at the center of the top thereof, the positioning member defines a limiting slot passing therethrough at substantial center, another locating pin is inserted in the second locating hole of the upper jig member through the limiting slot for movably locating the positioning member on the top of the upper jig member.

4. The apparatus for assembling cable to connector as claimed in claim 3, wherein one end of the positioning member defines a first opening positioning recess, and the other end of the positioning member defines a second opening positioning recess, the opening directions of the first positioning recess and the second positioning recess are opposite for receiving the two locating pins respectively inserted in the first and third locating holes.

5. The apparatus for assembling cable to connector as claimed in claim 2, wherein the jig holder includes a bottom board located at the bottom of the basic board, the center of the bottom board defines a strip-shaped slot passing therethrough, the two locating pins respectively inserted in the first locating holes and the third locating holes are disposed in the slot.

6. The apparatus for assembling cable to connector as claimed in claim 1, wherein the mounting space includes a mounting opening defined on the front of the basic board, the rear of the mounting opening defines a locking gap, a leading groove is defined on the rear top of the basic board communicating with the locking gap.

7. The apparatus for assembling cable to connector as claimed in claim 6, wherein the mounting opening passes through the basic board, two resisting blocks protrude from bilateral sides of the mounting opening face to face and disposed in the front of the mounting opening for locating the connector therebetween.

8. The apparatus for assembling cable to connector as claimed in claim 6, wherein the basic board extends upward at the front top thereof to form a assembling platform, the rear top of the basic board projects upward to form a strip of protruding block, the mounting opening and the locking gap are defined on the assembling platform, the leading groove upward passes through the protruding block and forward passes through the rear of the assembling platform to communicate with the locking gap.

9. The apparatus for assembling cable to connector as claimed in claim 8, wherein the jig holder includes a cover mating with the rear top of the basic board, the middle of a bottom surface of the cover defines a strip-shaped cavity to receive the protruding block.

10. The apparatus for assembling cable to connector as claimed in claim 6, wherein the jig holder includes a supporting lid covering on the top of the mounting opening, the supporting lid defines a hole passing therethrough at the center of the rear top thereof.

* * * * *